US005515809A

United States Patent [19]

Weinberg

[11] Patent Number: 5,515,809

[45] Date of Patent: May 14, 1996

[54] ADAPTABLE BOOKMARK

[76] Inventor: Ann M. Weinberg, 877 Summit Rd., Santa Barbara, Calif. 93108

[21] Appl. No.: 314,698

[22] Filed: Sep. 29, 1994

[51] Int. Cl.[6] ..... B42D 9/00

[52] U.S. Cl. ..... 116/235; 116/238; 116/239

[58] Field of Search ..... 116/234, 235, 116/238, 239, 240, 237, 236; 281/42

[56] References Cited

U.S. PATENT DOCUMENTS

| | | | |
|---|---|---|---|
| 2,591,094 | 4/1952 | O'Neill | 116/234 X |
| 3,143,998 | 8/1964 | Madden | 116/238 |
| 3,583,358 | 6/1971 | Hanson | 116/235 |
| 4,574,727 | 3/1986 | Martin, Jr. | 116/234 |
| 4,777,902 | 10/1988 | Martinez | 116/234 |
| 4,848,799 | 7/1989 | Turetsky | 281/42 |
| 4,901,665 | 2/1990 | Carlin | 116/235 |
| 5,101,756 | 4/1992 | Strumbos | 116/234 |
| 5,311,835 | 5/1994 | Knowles | 116/235 |
| 5,408,950 | 4/1995 | Porto | 116/239 |

FOREIGN PATENT DOCUMENTS

| | | | |
|---|---|---|---|
| 2448759 | 10/1980 | France | 116/234 |
| 3202077 | 8/1983 | Germany | 116/239 |
| 4125234 | 2/1993 | Germany | 116/239 |
| 0090393 | 4/1991 | Japan | 116/234 |
| 2150077 | 6/1985 | United Kingdom | 116/234 |
| 2223449 | 4/1990 | United Kingdom | 116/234 |
| 2275018 | 8/1994 | United Kingdom | 116/238 |
| 81/02867 | 7/1980 | WIPO | 116/239 |

*Primary Examiner*—Thomas B. Will
*Assistant Examiner*—Willie Morris Worth
*Attorney, Agent, or Firm*—David Pressman

[57] ABSTRACT

A bookmark (10) includes a head member (11) connected to an elongated, flexible tail member (13). Removable adhesive (12) is disposed on the head member for attaching the bookmark to the spine (15) of a book (16). The tail member is draped over the top of the book and positioned between two selected pages. A removable adhesive dot (14) disposed on the tail member allows it to be removably attached to one of the pages, thereby marking a specific piece of information and directing the attention of the reader thereto. In another embodiment, the head member (21) is U-shaped so that the title (27) of the book (26) is visible between the arms of the head. In yet another embodiment, the tail (55) includes several adhesive markers (56) that can each be independently attached to a different location on page. In still another embodiment, the tail (34) is separable along lines of perforations (33) into multiple tails (35) for marking different pages in the same book. In a further embodiment, the elongated tail (74) is formed of a wide, rectangular sheet folded in an accordion shape into a narrow strip, but can be unfolded for receiving a large volume of notes.

14 Claims, 3 Drawing Sheets

ADAPTABLE BOOKMARK

BACKGROUND

1. Field of Invention

This invention relates generally to bookmarks, specifically to an enhanced bookmark with adaptable functions.

2. Prior Art

Bookmarks are used for marking pages of interest in books; the simplest are elongated cards or strings that are held between two pages. However, these types of bookmarks merely place an object between two leaves of a book. As a result, readers can forget exactly where they left off in their reading or what they marked, so that they have to search the pages for the information or the last passage they read. Furthermore, these bookmarks can easily fall out from between the pages.

U.S. Pat. No. 4,574,727 to Martin, Jr. (1986) and U.S. Pat. No. 4,848,799 to Turetsky (1989) show bookmarks with an adhesive head for sticking to the spine or cover of a book, and a flexible tail extending from the head for disposing between any two selected pages of the book. However, they also cannot mark a specific piece of information, or even a specific page.

U.S. Pat. No. 4,901,665 to Carlin (1990) shows a bookmark with an indicator slidably disposed on an elongated card. The indicator can be slid along the card to indicate a particular line of interest on a page. However, it cannot mark a particular word or picture, and it can easily fall out of the book.

U.S. Pat. No. 3,583,358 to Hanson, Jr. (1971) and Japanese published patent application WO 81/02867 to Furukawa (1981) show adhesive bookmarks with arrows or indicators for attachment next to a line of interest. Several can be used for marking different locations in a book. Hanson's device includes a match-book-like container that houses several bookmarks that can be individually removed and used. However, both Hanson's and Furukawa's bookmarks are very small, so that if they are attached to the inner members of a page, they will not extend outside of the book. When the book is closed, they will no longer be visible, and the reader will not be able to easily find the pages they marked. They are also separate from each other, so that they can be easily misplaced after being removed.

Published U.K. patent application Nr 2, 150,077 of Rocchelli (1984) shows a bookmark with a clip for attachment to the spine or cover of a book. Several tails extend from the clip; each tail includes a marker slidably attached thereon for marking a particular line of interest. Each tail can be positioned between a different pair of pages. However, the markers cannot indicate which page in each pair the reader desires to mark.

These and all other prior art bookmarks are either prone to falling out of a book, or cannot indicate which of the two pages they mark contains the information of interest. Those that can indicate specific lines may be unable to mark the page because they are sometimes hidden when the book is closed.

OBJECTS AND ADVANTAGES

Accordingly, several objects and advantages of the invention are to provide an improved bookmark, a bookmark which can be securely attached to a book, which can removably mark a specific page of interest, which can mark a specific line of interest or piece of information, which can be easily and repeatedly repositioned for marking another piece of information or page, and which has enhanced or adaptable functions.

Other objects and advantages of the invention are to provide a bookmark which can mark many pages of a book at the same time, which can be divided into multiple bookmarks for use on different pages of the same book or in different books, which does not obscure the book's title on the spine, which provides spaces for receiving handwritten notes, which can be used as a book cover, and which can be reused.

Further objects and advantages will become apparent from a study of the following description and the accompanying drawings.

BRIEF DESCRIPTION OF THE DRAWING FIGURES

Figure 1A:
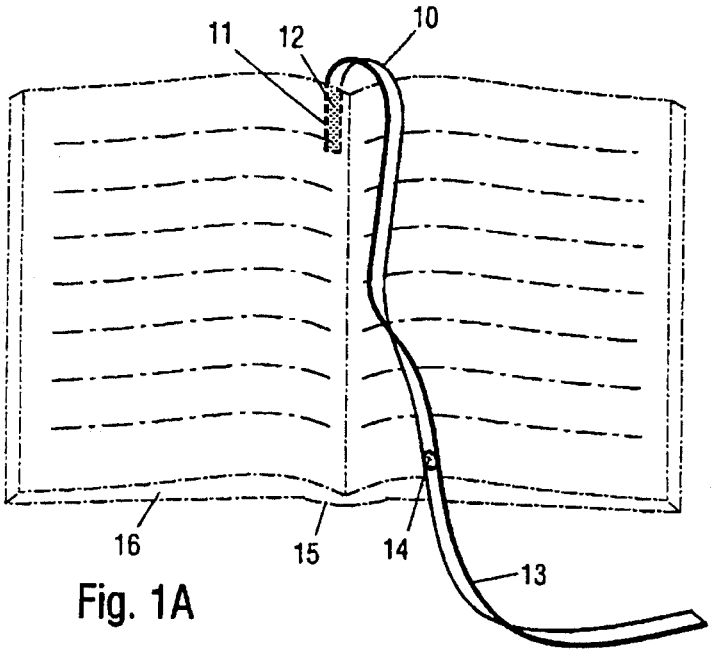
FIG. 1A is a front perspective view of a bookmark in accordance with a first embodiment of the invention.

| Drawing Reference Numerals | |
|---|---|
| 10. Bookmark | 11. Head Member |

-continued

| Drawing Reference Numerals | |
|---|---|
| 12. Adhesive | 13. Tail Member |
| 14. Adhesive Dot | 15. Spine Of A Book |
| 16. Book | |
| 20. Bookmark | 21. Head Member |
| 22. Tad Member | 23. Adhesive |
| 24. Adhesive Dot | 25. Spine Of A Book |
| 26. Book | 27. Title Of A Book |
| 30. Bookmark | 31. Head Member |
| 32. Adhesive | 33. Lines Of Perforations |
| 34. Tail Member | 35. Narrower Tails |
| 36. Adhesive Dot | |
| 40. Bookmark | 41. Head Member |
| 42. Adhesive | 43. Neck Member |
| 44. Tab | 45. Flap |
| 46. Adhesive | |
| 50. Bookmark | 51. Head Member |
| 52. Adhesive | 53. Neck Member |
| 54. Marker | 55. Tail Member |
| 56. Marker | 57. String |
| 58. Ring | 59. Flexible Adhesive Membrane |
| 60. Page | 61. Marker |
| 62. Ring | 63. Flexible Adhesive Membrane |
| 64. Hole | |
| 70. Bookmark | 71. Head Member |
| 72. Adhesive | 73. Neck Member |
| 74. Marker | 75. Pull Tab |
| 76. Adhesive | 77. Plastic Coating |
| 80. Bookmark | 81. Head Member |
| 82. Adhesive | 83. Tad Member |
| 84. Adhesive Strips | |
| 90. Bookmark | 91. Lines Of Perforations |
| 92. Strip | 93. Head Member |
| 94. Adhesive | 95. Tail Member |
| 96. Protective Backing | 97. Pad Of Bookmarks |
| 100. Bookmark | 101. Lines Of Perforations |
| 102. Strips | 103. Head Member |
| 104. Tail Member | 105. Adhesive |
| 106. Triangular Areas Of Exposed Adhesive | 107. Pad Of Bookmarks |
| 110. Bookmark | 111. Head Member |
| 112. Adhesive | 113. Tail Member |
| 114. Lifting String | |
| 120. Bookmark | 121. Adhesive |
| 122. Lines Of Perforations | 123. Adhesive Dot |

SUMMARY OF THE INVENTION

In one embodiment, a bookmark includes an adhesive head member for attaching to the spine of a book. An elongated tail member extending from the head includes an adhesive dot disposed near its midpoint for removably attaching to and indicating a line of interest on a selected page.

Figure 1B:
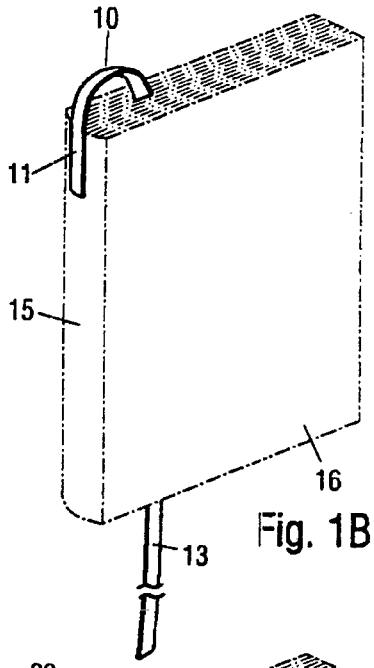
FIG. 1B is a rear perspective view of the bookmark of FIG. 1A.

Description—FIGS. 1A and 1B—First Embodiment

In accordance with a first embodiment of the invention as shown in the front and rear perspective views in FIGS. 1A and 1B, respectively, a bookmark 10 is made of a long, flexible, and flat strip of material, such as paper, Mylar film (duPont), rubber, elastomer, etc. Bookmark 10 includes a head member 11 with adhesive 12 disposed on its inner side. An elongated tail 13 extends from head member 11, and includes an adhesive dot 14 disposed near its midpoint, on the same side as adhesive 12. Tail 13 should be about twice as long as any book with which it is used. Adhesive 12 and 14 are removable adhesive, such as the type used by Minnesota Mining and Manufacturing Company on the note paper sold under the trademark Post-It Notes, which can be easily and repeatedly repositioned without damaging the book.

Head member 11 is securely attached to the top end of a spine 15 of a book 16 with adhesive 12 so that bookmark 10 will not fall off. Tail 13 is curved around the top of the book and positioned between two pages. Tail 13 is twisted to show adhesive dot 14, which can be securely attached to a selected piece of information on any one of the two pages to quickly and precisely direct a reader's attention thereto. Adhesive dot 14 can be easily detached from the page without damaging or leaving marks thereon, and it can be easily attached to another position on the page or on another page. Adhesive dot 14 can be repositioned in this manner many times without substantially loosing its adhesion. Tail 13 is long enough to extend substantially beyond book 16, so that it will not become hidden when the book is closed, and will always remain easily accessible for separating the pages. The flat tail 13 can conveniently receive handwritten notes thereon. Head member 11 can be easily detached from book 16 so that bookmark 10 can be used on another book.

In one embodiment, bookmark 10 is 400 mm long and 6 mm wide.

Figure 2A:
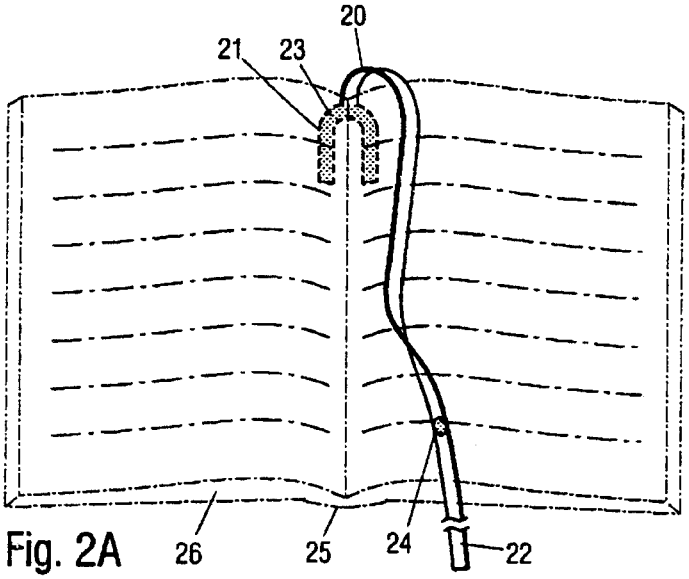
FIG. 2A is a front perspective view of a bookmark in accordance with a second embodiment of the invention.
Figure 2B:
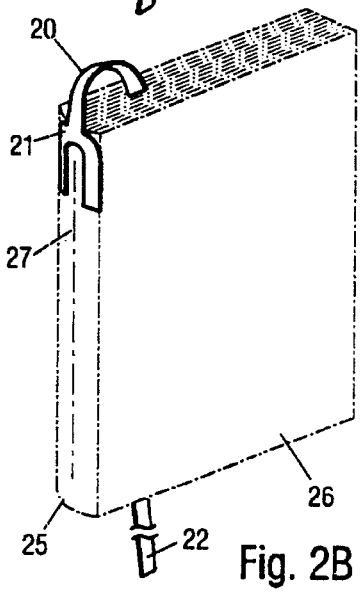
FIG. 2B is a rear perspective view of the bookmark of FIG. 2A.

Description—FIGS. 2A and 2B—Second Embodiment

In accordance with a second embodiment of the invention as shown in the front and rear perspective views in FIGS. 2A and 2B, respectively, a bookmark 20 includes a U-shaped head member 21 and a long, flat, flexible tail 22 extending therefrom. Removable adhesive 23 is disposed on the inner side of head member 21 for attaching it to a spine 25 of a book 26. A removable adhesive dot 24 is disposed on tail 22 at about its midpoint, on the same side of bookmark 20 as adhesive 23.

When head member 21 is attached to spine 25, the book's title 27 will remain visible in the open center of the U-shaped head member. The operation of tail 22 is identical to the tail of the first embodiment shown in FIGS. 1A and 1B. If necessary, head member 21 can be spread apart further for showing a larger area of information therein.

Figure 3:
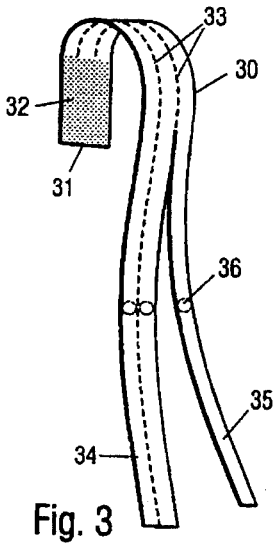
FIG. 3 is a front perspective view of a bookmark in accordance with a third embodiment of the invention.

Description—FIG. 3—Third Embodiment

In accordance with a third embodiment of the invention as shown in the front perspective view in FIG. 3, a bookmark 30 includes a head member 31 with removable adhesive 32 disposed thereon for attaching it to the spine of a book (not shown). Lines of perforations 33 extend along bookmark 30 from the end of a tail member 34 up to but not including head member 31. Perforations 33 are laterally spaced at regular intervals to allow bookmark 30 to be split into several narrower tails 35, which can each include an adhesive dot 36 disposed on its inner side for attaching to a page and marking selected information thereon. A tail 35 is shown partially separated.

Bookmark 30 can be used with tail member 34 whole for marking one page, or tails 35 can be individually separated as needed for marking additional pages in the same book. Bookmark 30 is shown with two lines of perforations 33 for separating up to three tails 35 for marking up to three different pages. Alternatively, bookmark 30 can be made narrower with one line of perforations, or bookmark 30 can be made wider with more lines of perforations 33 for creating more tails 35 than shown. Even when tails 35 are separated, they will remain connected together by head member 31, so that they can be conveniently carried as one device when removed from the book.

Figure 4:
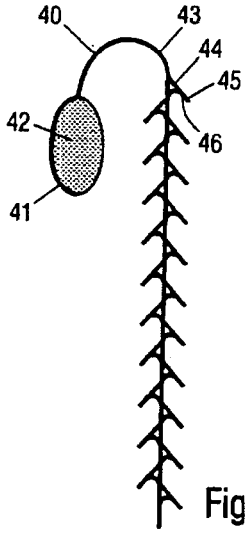
FIG. 4 is a front perspective view of a bookmark in accordance with a fourth embodiment of the invention.

Description—FIG. 4—Fourth Embodiment

In accordance with a fourth embodiment of the invention as shown in the front perspective in FIG. 4, respectively, a bookmark 40 includes a head member 41 with removable adhesive 42 disposed thereon for it attaching to the spine of a book (not shown). An elongated rubber tail 43 extends from head member 41. A staggered series of solid rubber, triangular tabs 44 are attached to tail 43. Each tab 44 includes a flexible rubber flap 45 extending therefrom outwardly and downwardly; each flap 45 includes a thin layer of removable adhesive 46 disposed on its inner side. Tabs 44 and flaps 45 are shown enlarged and not-to-scale; they should be much smaller in proportion to the size of tail 43, so that many more tabs-and-flaps than shown can be attached to tail 43.

In use, a portion of tail 43 is applied to a selected part of a page with a forwardly dragging motion, flaps 45 in that portion will be bent backwardly to expose adhesive 46 to the page. Tail 43 can be easily removed by lifting it from the page; flaps 45 will rebound to their original shape to prevent adhesive 46 from sticking to the page until direct pressure is applied thereto again.

Figure 5A:
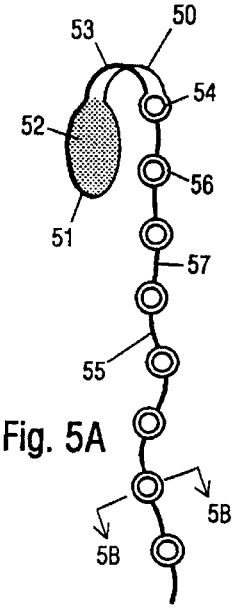
FIG. 5A is a front perspective view of a bookmark in accordance with a fifth embodiment of the invention.
Figure 5B:
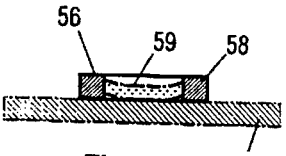
FIG. 5B is a side sectional view of a marker of FIG. 5A taken along line 5B—5B.

Description—FIGS. 5A and 5B—Fifth Embodiment

In accordance with a fifth embodiment of the invention as shown in the front perspective view in FIG. 5A, a bookmark 50 includes a head member 51 with removable adhesive 52 disposed on its inner side for attaching it to the spine of a book (not shown). A flexible neck member 53 extends from head member 51 and has a round marker 54 attached to an end thereof. A tail 55 extends from marker 54; tail 55 includes several round markers 56 linked by short sections of flexible string 57. Tail 55 can be draped over the top of a book and held between selected two pages (not shown).

As shown in the enlarged side sectional view in FIG. 5B, each marker 54 and 56 includes a non-adhesive, rigid ring 58 surrounding a flexible, adhesive membrane 59 which is thinner than ring 58 and is sticky on both sides. In use, membrane 59 of one or more markers is pressed and stretched onto a page 60 so that it adheres thereon for marking selected information thereon. Markers that are not needed will not stick to the page because their adhesive membranes 59 will be elevated therefrom by ring 58. Markers 54 and 56 can be easily removed from the page and repositioned thereon or on another page. Because tail 55 is flexible, as many markers as necessary can be used for marking different positions on the page.

Figure 6:
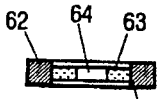
FIG. 6 is a side sectional view of a bookmark in accordance with a sixth embodiment of the invention.

Description—FIG. 6—Sixth Embodiment

In accordance with a sixth embodiment of the invention as shown in the side sectional view in FIG. 6, a marker 61 can be used for substituting markers 54 and 56 shown in FIGS. 5A and 5B. Marker 61 includes a ring 62 with a membrane 63 that includes a central hole 64.

Figure 7A:
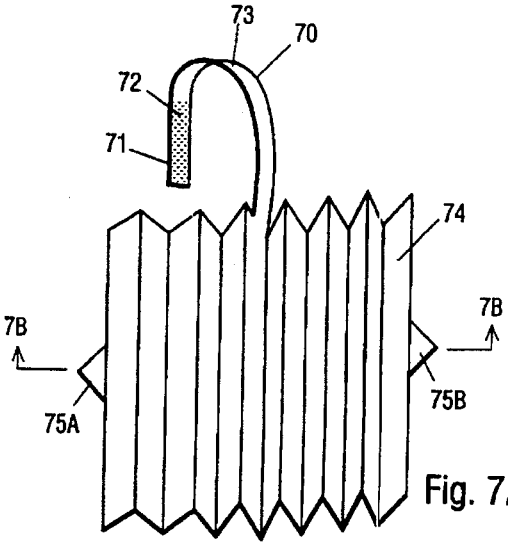
FIG. 7A is a front perspective view of a bookmark in accordance with a seventh embodiment of the invention.
Figure 7B:
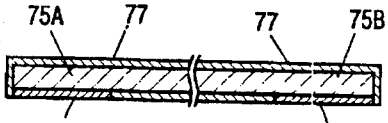
FIG. 7B is a side sectional view of the bookmark of FIG. 7A taken along line 7B—7B.

Description—FIGS. 7A and 7B—Seventh Embodiment

In accordance with a seventh embodiment of the invention as shown in the front perspective view in FIG. 7, a bookmark 70 includes a head member 71 with removable adhesive 72 disposed thereon for attaching it to the spine of a book (not shown). An integral, flexible neck member 73 extends from head member 71. Attached integrally to the end of neck member 73 is an accordion-shaped marker 74 with longitudinal folds and a pair of pull tabs 75A and 75B on either side, each of which includes removable adhesive 76 disposed on their lower sides, as shown in the side sectional view in FIG. 7B. Marker 74 is laminated with a plastic coating 77 or otherwise reinforced to make the folds more durable.

Marker 74 is shown partially expanded; it is normally folded into a compact shape for convenient storage and handling. It can be used in its folded form for marking a page, or it can be expanded into a rectangular card by pulling apart tabs 75A and 75B and sticking them onto a page (not shown). When marker 74 is fully expanded, it provides a large surface area for receiving notes or the like.

Alternatively, marker 74 can be made of a completely transparent material, and sized for expanding beyond the edges of an open book, so that if the book is laid down on a desk or counter, marker 74 can be stretched across the open pages, and tabs 75A and 75B can be attached to the desk or counter for keeping the book open and protecting it from spills, but will still allow the book to be read.

Figure 8A:
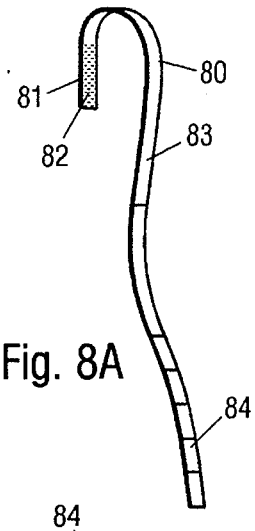
FIG. 8A is a front perspective view of a bookmark in accordance with an eighth embodiment of the invention.
Figure 8B:
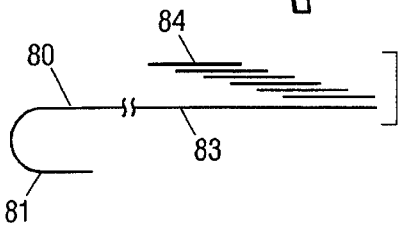
FIG. 8B is an exploded side view of the bookmark of FIG. 8A.

Description—FIGS. 8A and 8B—Eighth Embodiment

In accordance with an eighth embodiment of the invention as shown in the front perspective and exploded side views in FIGS. 8A and 8B, respectively, a bookmark 80 includes a head member 81 with removable adhesive 82 disposed thereon for attaching it to the spine of a book (not shown). An integral, flexible tail 83 extends from head member 81 for marking pages in the book. Disposed on tail 83 is a staggered stack of adhesive strips 84, which can be easily peeled off and attached to various pans of the book for marking information of interest or for receiving handwritten notes.

Figure 9A:
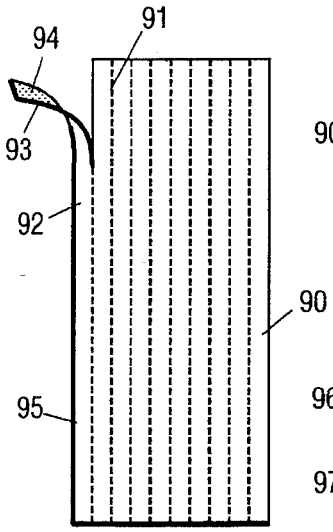
FIG. 9A is a front perspective view of a bookmark in accordance with a ninth embodiment of the invention.
Figure 9B:
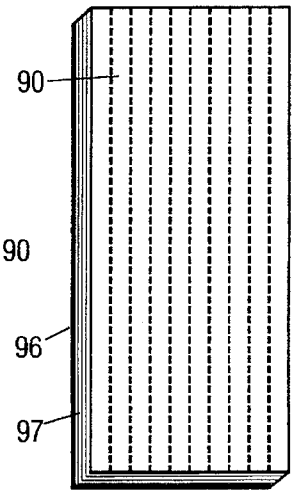
FIG. 9B is a front perspective view of a stack of bookmarks of FIG. 9A.

Description—FIGS. 9A and 9B—Ninth Embodiment

In accordance with a ninth embodiment of the invention as shown in the front perspective view in FIG. 9A, a bookmark 90 is a wide, rectangular sheet with parallel lines of perforations 91 extending between its top and bottom ends for dividing it into strips 92. Bookmark 90 can be used whole for marking a page, or it can be separated into individual strips 92 for marking multiple pages in one or more books (not shown). Each strip 92 includes a head member 93 with removable adhesive 94 disposed thereon for attaching it to the spine of a book (not shown); strip 92 also includes a tail member 95 for marking a page in the book. The left-most strip 92 is shown partially separated.

Many bookmarks 90 can be stacked together to form a convenient dispensing pad 97, as shown in FIG. 9B. Each sheet is attached to the one underneath by adhesive 94 (not shown) on head members 93. Bookmarks 90 can be individually removed from pad 97 by peeling them off. A protective backing 96 protects the adhesive (not shown) on the lowest bookmark 90.

Figure 10A:
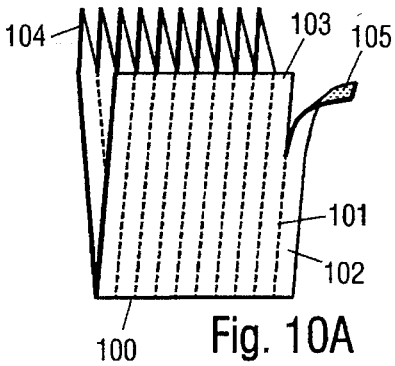
FIG. 10A is a front perspective view of a bookmark in accordance with a tenth embodiment of the invention.
Figure 10B:
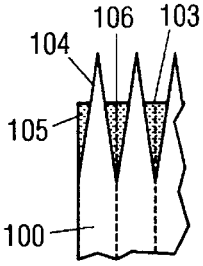
FIG. 10B is a bottom view of the bookmark of FIG. 10A when fully folded.
Figure 10C:
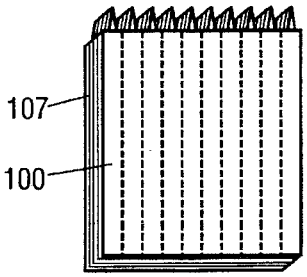
FIG. 10C is a front perspective view of a stack of bookmarks of FIG. 10A.

Description—FIGS. 10A to 10C—Tenth Embodiment

In accordance with a tenth embodiment of the invention as shown in the from perspective view in FIG. 10A, a bookmark 100 includes a sheet with parallel lines of perforations 101 extending between two ends thereof for dividing it into separable strips 102. Each strip 102 includes a blunt head member 103 and a tapered tail member 104. Each head member 103 includes removable adhesive 105 disposed on its inner side for attaching it to the spine of a book (not shown). The rightmost strip 102 is shown partially separated. Bookmark 100 is folded so that tails 104 extend completely beyond heads 103 for protecting adhesive 105.

Alternatively, bookmark 100 can be folded so that tails 104 partially cover adhesive 105, which leaves triangular areas of adhesive 106 exposed, as shown in the rear view in FIG. 10B, to allow sheets of bookmarks 100 to stick together in a stack or pad 107, as shown in the front perspective view in FIG. 10C. Bookmarks 100 can be individually peeled off pad 107. When a bookmark 100 is thus removed, it can be used whole for marking a page, or strips 102 can be separated therefrom for marking different pages.

Figure 11:
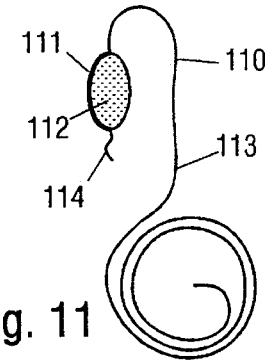
FIG. 11 is a front perspective view of a bookmark in accordance with a eleventh embodiment of the invention.

Description—FIG. 11—Eleventh Embodiment

In accordance with an eleventh embodiment of the invention as shown in the front perspective view in FIG. 11, a bookmark 110 includes a head member 111 with removable adhesive 112 disposed thereon for attaching it to the spine of a book (not shown). A flexible, string tail 113 extends from an upper end of head member 111 for marking a desired page in the book; tail 113 is provided in a coil for unwinding by the user. A short, lift string 114 attached to a lower end of head member 111 provides a convenient grip for lifting bookmark 110 from the coiled position, or off the book when the user wishes to remove bookmark 110.

Figure 12:
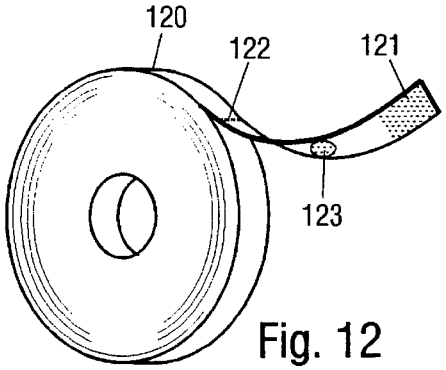
FIG. 12 is a front perspective view of a bookmark in accordance with a twelfth embodiment of the invention.

Description—FIG. 12—Twelfth Embodiment

In accordance with a twelfth embodiment of the invention as shown in the front perspective view in FIG. 12, a long, ribbon bookmark 120 is formed into a continuous roll, and includes adhesive 121 and lines of perforations 122 disposed alternately at regular intervals, so that it can be gradually unrolled and separated into individual bookmarks of equal length for marking different pages in the same book or in different books. Each individual bookmark also includes an adhesive dot 123 for attaching to a page.

SUMMARY, RAMIFICATIONS, and SCOPE

Accordingly the reader will see that I have provided an improved bookmark with enhanced or adaptable functions. In its various embodiments, it can be securely but removably attached to the spine of a book so that it will not fall off, and without obscuring the book's title on the spine; it can mark one or more pieces of information on a specific page to quickly and accurately direct the reader's attention thereto; it can be repeatedly repositioned on the same page or on other pages; it can mark many pages in the same book, or it can be separated into individual strips of bookmarks for use in different books; it provides a convenient space thereon for receiving handwritten notes or the like; it can be expanded from a compact and narrow strip into a wide card for receiving a great volume of notes; and it can be conveniently dispensed from a pad or a roll.

Although the above descriptions are specific, they should not be considered as limitations on the scope of the invention, but only as examples of the preferred embodiments. Many additional ramifications and variations are possible within the teachings of the invention. For example, in the first embodiment, the adhesive dot can be disposed at other locations on the tail, such as at the distal end for attaching it to the outside of the book, or for marking a particular word on the page, and the tail need not be twice as long as the book if the adhesive is disposed at other locations; near the head for marking the entire left or right page; or intermittently along the tail to keep the entire tail firmly in place in the book and may be draped around the outside. The adhesive head member and the dot on the tail may each be provided with a removable protective backing. In the second embodiment, the distal ends of the arms of the U-shaped head can be originally joined together, but can be easily separable along a line of perforations for use. The head and tail can be reinforced with a plastic coating for durability over prolonged use. The tail can be made very short, and have an adhesive dot disposed at its distal end for marking only the left or right-side page. A short lifting string can be provided on the head and/or tail. The tail can be provided with an adhesive-free area for easy lift.

In the second and third embodiments, the adhesive spot can be disposed at other locations along the tail, such as near the head, distal end, or intermittently along the tail.

In the third embodiment, each of the adhesive spots can be covered with a peel-off protective backing. The tails can be provided already separated. There can be two separable tail strands each having adhesive dots at its midpoint and its distal end; the strands separate back only to the adhesive dot at midpoint. This allows a strand's adhesive dot at midpoint to be attached to the inside column of a page, while the distal end of the strand can be attached to the outside of the book. The strands can be thin enough so that they do not interfere with the print in the book. Alternatively, the split tail does not need to have adhesive at its midpoint, but only at the distal ends, so that the separate strands can be spread across the book and stuck to a surface beyond the book, such as a desk, for keeping the book open. The midpoint of the tail can be reinforced for preventing further separation. There can be more than one adhesive spot covered with peel-off backings, on the distal ends. The adhesive can be a permanent adhesive. Instead of adhesive, suction cups, magnets, putty, or other attaching devices can be used. There can be adhesive on other places on the tail. The heads can be attached to the binding of a book by being sewn thereon or attached with permanent adhesive.

In the fourth embodiment each of the flaps can have a wider distal end for receiving more adhesive. The tabs with adhesive flaps can be evenly spaced radially around the string tail so that some will stick to the page regardless of the orientation of the tail. The string tail can be replaced with a flat ribbon, and can be made of a stretchable material, such as rubber, and can be coiled. The head can be provided with a lift string. The tabs do not have to be spaced regularly. Each tab can have more than one flap. If the tail is a ribbon, the tabs can be provided on one or both sides. The neck and distal end of the tail can be free of adhesive or tabs. The adhesive under each flap does not have to cover the entire surface thereof. The tabs can be connected by rubber threads to form a mesh, so that the tail can be draped around the book. This mesh can be made into a string marker with the tabs on one side, and the rubber threads on the back. A lib string can be provided on the head. The tail can be either rolled or coiled. The tabs can be spaced close enough together so that a finger cannot be inserted between two tabs.

In the fifth embodiment, the adhesive membranes in the markers may be sticky on just the lower side, and can be flush with the top surface of the ring. One or more adhesive markers can be made slidable along a continuous tail, so that they can be moved to any desired position thereon. The head and neck can be eliminated, so that the first round marker is used as a head. The tail can be rolled, and kept rolled with an adhesive membrane. There can be one or more round markers on a bookmark; the round markers can be of other shapes, such as oval or rectangular. The string can be replaced with a ribbon. The string can be eliminated, and the round markers directly but flexibly connected together. The tail can be a ribbon, and the ring markers eliminated. The ribbon can be provided with finger-sized holes each covered with an adhesive membrane on one side. The membranes can also have small holes therein. The ribbon can be thick enough to suspend the membranes off a page. The round membranes can be provided with adhesive-free rims so that when they are depressed onto a page, they will not stick to the inside of the holes on the ribbon. The membranes can be detachable from the ribbon, so that they can be removed when they are worn to reduce confusion about which membrane still works. The membranes can also be detachable so that they can be individually positioned at different points on a page. The membranes can have adhesive-free outer edges for easy lifting, which can also extend beyond the edges of the ribbon. A rigid ring can be provided under each membrane. The tail can be rolled or coiled. The tail can be devoid of holes so that the membranes are simply distributed therealong. A piece of charcoal, chalk, or other marking device can be attached to a membrane. The marking device can have a hole that corresponds to the hole in the membrane. The marking device can be attached to the bookmark with a permanent adhesive so that it will not fall out with use. The membrane can be a stretchable but sturdy material so that it will rebound with certainty. The portion of the tail around the marking device can be thicker to provide a housing. The marking device can be smaller than the membrane, and can be of various shapes, such as a thin bar for underlining words. The marking device can be provided in different colors for visibility. Several marking devices can be provided on the tail. The tail can be a string or a ribbon. The lower side of the tail can be provided with one or more adhesive spots protected with peel-off sheets. The bookmark can have a combination of adhesive membranes and adhesive membranes with marking devices on the same tail. The adhesive membranes can be used to pick up marking dust. The tail can have putty or an eraser, which is adhered thereto with removable or permanent adhesive, for removing marks. The tail can be coiled like a snake, and the putty or eraser can be shaped like the rattle of a rattle snake. The adhesive membrane can be provided with one or more absorbent members filled with marking liquid, such as a felt material with highlighter fluid. The bookmark can be a simple, rigid card having adhesive membranes with or without the marking device. The card can be provided with perforated lines for separation into multiple cards.

In the seventh embodiment, the head of the bookmark can be permanently attached to the book by being sewn thereon. The neck can be of a different length than shown, and the number of folds in the marker can be different. The pull tabs can be folded against the sides of the marker so that they will not stick to the book until they are peeled open, or they can be eliminated. The pull tabs can be provided with short lifting strings so that they can be unfolded easily. The pull tabs can be provided with peel-off protective backings, or they can be adhesive-free. Adhesive spots can be disposed between the accordion sections for keeping them together when the marker is folded for storage. The head can be permanently attached to the book with permanent adhesive or by being sewn thereon. The folds of the accordion marker can be free of lamination so that it will be easier to fold. The lamination can be eliminated by providing thicker planar sections that are more rigid than the folds. The head and neck can be eliminated, and marker can be without predetermined folding lines. The opposite side edges of the marker can be reinforced with rigid strips for easy handling. A stack of the markers, which can be disposable, can be housed in a box and folded so that they can be dispensed like napkins. Many markers can be connected along perforated lines and rolled together. Adhesive can be disposed along the side edges, or they can be spaced intermittently at regular intervals, so that on a roll, either with or without the perforations, can be cut into any length to fit different books with the adhesive attached to a surface outside of the book on two opposite sides, whether it be the top and bottom sides or left and right sides. The roll can be cut into markers of any length to fit different books. The pull tabs can be folded with one or more accordion folds to protect the adhesive thereunder. The adhesive can be a permanent adhesive.

In the eighth embodiment, the adhesive strips may be stacked directly on top of one another instead of being staggered. They can extend beyond the tail for easy separation; they may be attached to the tail by a perforated connection; and they may each include a protective backing sheet. They can be made of a transparent material, such as Mylar, so that they will not cover information on the page. They can also be tapered at one or both ends. The adhesive on each strip can partially cover its bottom side, so that the staggered strips only adhere to the tail, and not each other to prevent lifting more than one strip at a time. Adhesive strips can be attached to both sides of the tail, or around a string tail. The bookmark can be rolled.

In the ninth embodiment, the bookmark can be provided with a peel-off protective backing, which can also be perforated along the same lines. The different layers of markers can be of different colors, so that a partially used layer will be immediately apparent because the differently colored strips on the next layer will be visible.

In the eleventh embodiment, the coiled tail can be provided on an adhesive backing sheet, or several bookmarks can be stacked on top of one another. The string tail can be provided with a very small area of adhesive somewhere thereon for marking a specific part of a page. The different layers of markers can be of different colors, and the head or tails of different layers can be of different shapes, so that a partially used layer will be immediately apparent because the differently colored or shaped strips on the next layer will be visible. Many bookmarks can be stacked together, but separated by backing sheets. The backing sheet can be an elongated strip extending across the coiled tail. The bookmark can be coiled so that the head is in the center of the coil. The backing sheet can be eliminated by using the head as a backing sheet for the tail.

In the twelfth embodiment, the perforations can be eliminated, but instead the roll can be separated into sections of any desired length with a dispenser having a built-in cutter, such as those typically used for dispensing adhesive tape. Instead of having adhesive along the entire length of the roll, it can be provided with spots of adhesive spaced apart at regular intervals. A cardboard or plastic tube can be provided in the center of the roll.

In all embodiments, the shapes of the head and tails can be changed; they can be made of a transparent material, such as Mylar film, so that information on the page or spine will be visible therethrough; or they can be made of an elastic material, such as rubber, so that they will rebound into their original shapes after use. A mark for the adhesive dot can be added to the opposite side of the tail member for locating it. Each adhesive dot can be supplemented with a cluster of additional adhesive dots near the same location, each with its own peel-off backing, can be provided on the tail member, so that when one looses its stickiness, another one can be used. The tails may be transparent so that the peel-off backings of the adhesive dots can be seen from the front to serve as location markers for the dots. Instead of an adhesive dot, a long strip of adhesive can be provided on the tail member; the adhesive can be provided with a correspondingly long strip of peel-off backing sheet, which can be peeled and tom off gradually in short sections as needed, or it can be divided by perforated lines at regular intervals for tearing. Alternatively, the adhesive on the tail member can be eliminated. The adhesive spots can be located in other positions. A bookmark with an adhesive spot at the distal end can be positioned across an open book, with the adhesive attached to a surface beyond the book, such as a desk, to keep the book open. The necks of the bookmarks can be narrower for more flexibility, and can be adhesive-free. Any head can be provided with a peel-off protective sheet. The head can be attached to the binding of a book, under the spine. The tail can be adhered to a writing instrument, which can be provided with a cap. The tail can have split ends. Separate tails can be attached to crayon or the like. In the embodiments in which the bookmark can be rolled, many bookmarks can be connected together by adhering one's head to another's tail, and the long string of bookmarks rolled into a ball. The bookmarks can also be connected head-to-tail by lines of perforations and rolled into a ball. The ball can be housed in a cardboard or plastic housing to prevent it from unraveling. The housing can have a built-in cutter for a ball of continuous bookmarkers with or without the perforations, and the housing can have adhesive on its bottom with a peel-off protective backing, so that the housing can be mounted on a desk and can remain stationary on the desk when a bookmark is pulled out of the housing. Removable adhesive can be disposed near the cutter for holding the bookmark for cutting. The bookmarks on a roll can be cut into any length for marking an exact word on a page and extend outside of the book, without being attached to the spine. Peel-off backing sheets can also have adhesive on their inner sides for preventing accidental separation from the bookmarks.

Therefore the scope of the invention should not be determined by the examples given, but by the appended claims and their legal equivalents.

I claim:

1. A bookmark comprising:

a head member, a flexible elongated tail member extending from said head member, attaching means on said head member for attaching said head member to a portion of an exterior surface of a book, and an exposed adhesive portion disposed on a part of said tail member, said adhesive portion being removably attachable and reattachable to a selected position on a selected page of said book where said reader stopped reading so that a reader of said book can use said adhesive portion to mark said position on said page where said reader stopped reading and thereby resume reading at the exact place where said reader stopped reading.

2. The bookmark of claim 1 wherein said adhesive portion is at an end of said tail member.

3. The bookmark of claim 1 wherein said head member and said tail member are formed of a homogeneous flat strip of material.

4. The bookmark of claim 1 wherein said adhesive portion is disposed generally at a midpoint of said elongated tail member.

5. The bookmark of claim 1 wherein said head member includes a pair of spaced arms which are joined at corresponding ends to form a U-shape, so that when said head member is attached to a spine of said book, information on said spine will be visible between said arms.

6. The bookmark of claim 1 wherein said head member has a predetermined width and length, said tail member being narrower and longer than said head member.

7. The bookmark of claim 1, further including a release portion attached over said adhesive portion to protect it before use, said release portion being removable to expose said adhesive portion.

8. A method of marking a selected passage on a page of a book where a reader stopped reading, comprising:

providing a bookmark having a head member, said head member including attaching means for attaching said head member to a portion of an exterior surface of a book, a flexible elongated tail member connected to said head member, and an exposed adhesive patch disposed on a portion of said tail member, said adhesive patch being removably attachable and reattachable to said passage of said page of said book, attaching said adhesive patch on said portion of said tail member to said passage of said page of said book for directing a user's attention thereto so as to remind said reader where said reader stopped reading.

9. The bookmark of claim 8 wherein said adhesive patch is covered with a release sheet and said release sheet is removed prior to use.

10. The bookmark of claim 8 wherein said head member and said tail member are formed of a homogeneous flat strip of material.

11. The bookmark of claim 8 wherein said adhesive patch is disposed generally at a midpoint of said elongated tail member.

12. The bookmark of claim 8 wherein said head member includes a pair of spaced arms which are joined at corresponding ends to form a U-shape, so that when said head member is attached to a spine of said book, information on said spine will be visible between said arms.

13. The bookmark of claim 8 wherein said adhesive patch is at an end of said tail member.

14. The bookmark of claim 8, further including a release portion attached over said adhesive portion to protect it before use, said release portion being removable to expose said adhesive portion.

* * * * *